US010549135B2

(12) United States Patent
Helasuo et al.

(10) Patent No.: US 10,549,135 B2
(45) Date of Patent: Feb. 4, 2020

(54) WATER MIST FIRE SUPPRESSION SPRINKLER WITH A POLYMER SEAL

(71) Applicant: MARIOFF CORPORATION OY, Vantaa (FI)

(72) Inventors: Jarmo Helasuo, Espoo (FI); Arto Huotari, Helsinki (FI)

(73) Assignee: MARIOFF CORPORATION OY, Vantaa (FI)

( * ) Notice: Subject to any disclaimer, the term of this patent is extended or adjusted under 35 U.S.C. 154(b) by 498 days.

(21) Appl. No.: 14/376,208

(22) PCT Filed: Jan. 31, 2013

(86) PCT No.: PCT/GB2013/050217

§ 371 (c)(1),
(2) Date: Aug. 1, 2014

(87) PCT Pub. No.: WO2013/117907

PCT Pub. Date: Aug. 15, 2013

(65) Prior Publication Data

US 2014/0374126 A1 Dec. 25, 2014

Related U.S. Application Data

(60) Provisional application No. 61/595,766, filed on Feb. 7, 2012.

(51) Int. Cl.
*A62C 35/68* (2006.01)
*A62C 99/00* (2010.01)
(Continued)

(52) U.S. Cl.
CPC ..... *A62C 35/68* (2013.01); *A62C 31/05* (2013.01); *A62C 37/14* (2013.01); *A62C 99/0072* (2013.01); *B05B 1/00* (2013.01)

(58) Field of Classification Search
CPC ..... A62C 37/08; A62C 37/11; A62C 37/12; A62C 37/14; A62C 37/16; B05B 1/3026; B05B 1/3013; B05B 1/30
(Continued)

(56) References Cited

U.S. PATENT DOCUMENTS 4,007,878 A * 2/1977 Anderson ..... A62C 37/10 169/37
4,109,727 A 8/1978 Job
(Continued)

FOREIGN PATENT DOCUMENTS

CN 1701828 11/2005
CN 1730163 2/2006
(Continued)

OTHER PUBLICATIONS

Chinese Search Report for Chinese Application No. 201380008398.7, dated Jan. 20, 2016.
(Continued)

*Primary Examiner* — Arthur O. Hall
*Assistant Examiner* — Tuongminh N Pham
(74) *Attorney, Agent, or Firm* — Carlson, Gaskey & Olds

(57) ABSTRACT

An exemplary fire suppression sprinkler includes a housing (22) that establishes a flow path for discharging fire suppression fluid. A water seat (28) is configured to block the flow path. A polymer seal (30) is supported within the housing (22) and engages the water seat (28) for sealing an interface between the flow path and the water seat (28). A spring member (40) biases the polymer seal (30) into engagement with the water seat (28).

20 Claims, 3 Drawing Sheets

(51) Int. Cl.
*A62C 31/05* (2006.01)
*A62C 37/14* (2006.01)
*B05B 1/00* (2006.01)

(58) Field of Classification Search
USPC ..... 169/37, 38, 41; 239/526, 569
See application file for complete search history.

(56) References Cited

U.S. PATENT DOCUMENTS

| | | | | | |
|---|---|---|---|---|---|
| 4,217,961 | A * | 8/1980 | Wotton | A62C 37/10 | 169/41 |
| 4,449,718 | A | 5/1984 | Muller | | |
| 4,619,327 | A * | 10/1986 | Pieczykolan | A62C 37/14 | 169/38 |
| 4,648,459 | A | 3/1987 | Pieczkolan | | |
| 4,657,085 | A | 4/1987 | Jacobsen | | |
| 4,739,835 | A | 4/1988 | Polan et al. | | |
| 4,830,115 | A | 5/1989 | Polan | | |
| 4,905,766 | A | 3/1990 | Dietz et al. | | |
| 4,991,656 | A | 2/1991 | Polan | | |
| 5,494,114 | A | 2/1996 | Hoening et al. | | |
| 5,732,778 | A | 3/1998 | Tateno | | |
| 5,775,431 | A * | 7/1998 | Ondracek | A62C 37/14 | 169/37 |
| 5,836,397 | A | 11/1998 | Craig et al. | | |
| 6,044,912 | A | 4/2000 | Tsuji et al. | | |
| 6,112,821 | A | 9/2000 | Yokoi | | |
| 7,510,128 | B2 * | 3/2009 | Schouten | B05B 1/308 | 239/530 |
| 2006/0113093 | A1 * | 6/2006 | Silva, Jr. | A62C 37/14 | 169/37 |
| 2008/0105440 | A1 | 5/2008 | Jackson et al. | | |
| 2008/0217572 | A1 | 9/2008 | Job | | |

FOREIGN PATENT DOCUMENTS

| | | |
|---|---|---|
| GB | 948099 | 1/1964 |
| GB | 2182243 | 5/1987 |
| WO | 9604044 | 2/1996 |

OTHER PUBLICATIONS

International Preliminary Report on Patentability for International application No. PCT/GB2013/050217 dated Aug. 21, 2014.

International Search Report and Written Opinion of the International Searching Authority for International Application No. PCT/GB2013/050217 dated Feb. 7, 2014.

* cited by examiner

WATER MIST FIRE SUPPRESSION SPRINKLER WITH A POLYMER SEAL

CROSS REFERENCE TO RELATED APPLICATIONS

This application claims priority to U.S. Provisional Patent Application No. 61/595,766 filed Feb. 7, 2012.

BACKGROUND

Fire suppression systems typically involve sprinklers positioned strategically within an area where fire protection is desired. The sprinklers remain inactive most of the time. Even though the sprinklers are inactive, many systems include fire suppression fluid within the conduits that supply the sprinklers. The fluid is pressurized and it is necessary to maintain an adequate seal to prevent any leaks at the sprinklers while they are inactive.

A variety of sealing arrangements are known within the industry. Different types of sprinklers can include different types of seals. Relatively low pressure water sprinklers include seals that withstand pressures according to industry standards. Such seals may not be acceptable, however, for higher pressure systems. Misting systems, in particular, may include much higher pressures and, therefore, may require a different type of seal to satisfy industry standards. Seals that are acceptable for lower pressure systems may not perform adequately within higher pressure systems such as water misting systems.

SUMMARY

An exemplary fire suppression sprinkler includes a housing that establishes a flow path for discharging fire suppression fluid. A water seat is configured to block the flow path. A polymer seal is supported within the housing and engages the water seat for sealing an interface between the flow path and the water seat. A spring member biases the polymer seal into engagement with the water seat.

The various features and advantages of disclosed example embodiments of this invention will become apparent to those skilled in the art from the following detailed description. The drawings that accompany the detailed description can be briefly described as follows.

DETAILED DESCRIPTION

Figure 1:
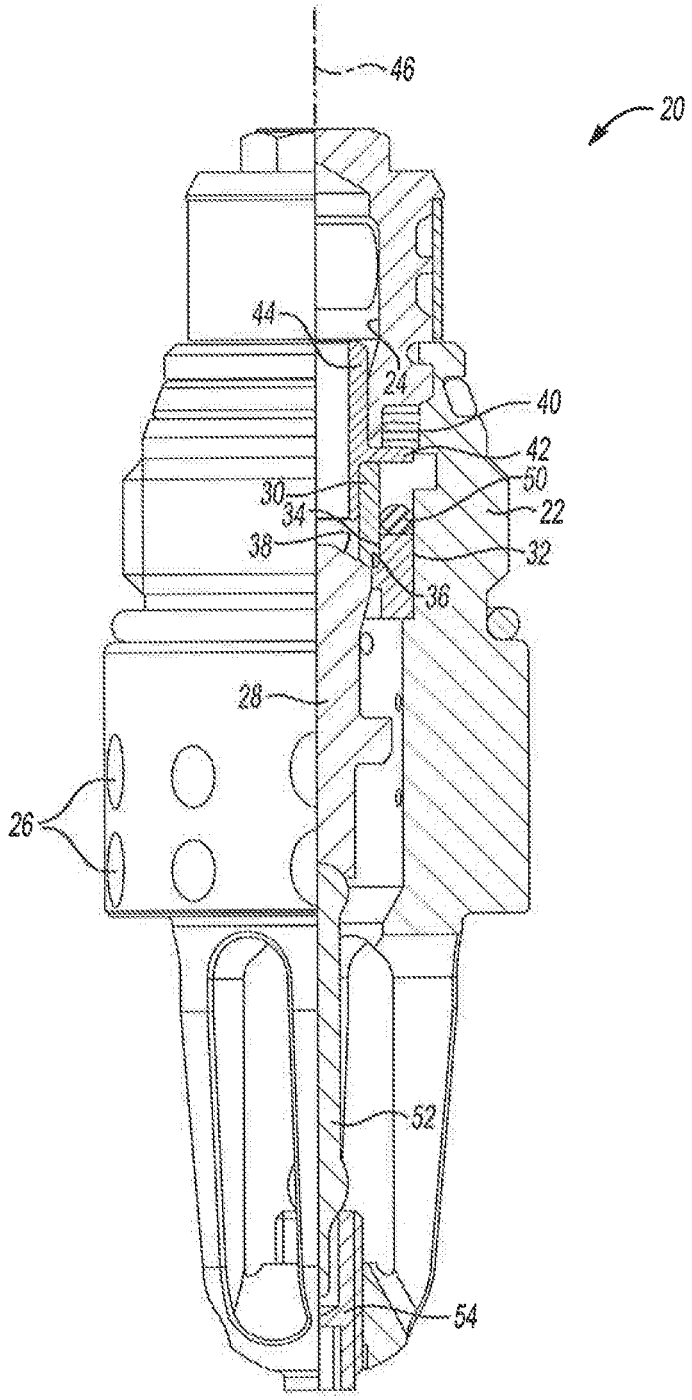
FIG. 1 is a partial-cross-sectional view of an example embodiment of a fire suppression sprinkler.

FIG. 1 illustrates an example fire suppression sprinkler 20 that is configured to discharge a mist of fire suppression fluid such as water. The sprinkler 20 includes a body 22 that establishes a flow path 24 through at least a portion of the body 22 so that fire suppression fluid may be discharged from openings 26.

A water seat 28 is configured to close off the flow path 24 when the sprinkler 20 remains inactive and there is no need for fire suppression. A polymer seal 30 seals an interface between the water seat 28 and the flow path 24. The seal 30 in this example comprises a polymer bushing that is generally cylindrical and annular.

The seal 30 in this example includes a side wall that has a length that is greater than a thickness of the side wall as can be appreciated from the illustration. In one example, the side wall of the seal is approximately 2 mm thick and establishes a 4 mm inner diameter that is open and through which fire suppression fluid may flow. An axial length of the sidewall in one such example is approximately 50 mm. The outer diameter of the seal 30 is approximately 6 mm in one example.

In one example, the seal 30 comprises polytetrafluoroethylene (PTFE). Other polymers having characteristics similar to PTFE are used in other examples. The selection of an appropriate polymer for the seal 30 will depend, in part, on the characteristics of the fire suppression fluid used in a particular installation. For example, if antifreeze or another chemical is included within the fire suppression fluid that may have an adverse reaction with a particular polymer, that will control the selection of a polymer material. Polyurethanes are useful in examples in which there are no corrosive components within the fire suppression fluid but would not be desired within examples that include antifreeze.

One feature of the polymer material of the seal 30 is that it is not a cross-linked elastomer. Some elastomers such as rubber are not considered to satisfy industry standard requirements for misting fire suppression sprinklers that operate at relatively high pressures. For example, when the system is inactive, the seal 30 must withstand pressure on the order of 25 bar. In some example misting sprinkler systems, the pressure during activation increases to 140 bar. Some sealing arrangements that were useful in lower pressure fire suppression systems may not be considered acceptable for higher pressure, misting systems. The polymer seal 30, on the other hand, is capable of withstanding the pressures associated with a misting system and provides an adequate seal.

The illustrated example includes a support ring 32 within the housing 22. In some examples the support ring 32 is a separate piece inserted within the housing 22. In other examples, the support ring 32 is formed as part of the housing 22. The seal 30 is received against the support ring 32 near the interface between the flow path 24 and the water seat 28.

In the illustrated example, the seal 30 is received against a first surface 34 of the support ring 32 and a second surface 36 of the support ring 32. The seal 30 is also received against a surface 38 on the water seat 28. The presence of the seal 30 against the surfaces 34, 36 and 38 is effective to seal off the interface between the flow path 24 and the water seat 28 to maintain fire suppression fluid under pressure within the sprinkler 20 without any leaks.

The illustrated example includes a spring 40 that is situated for biasing the seal 30 into engagement with the water seat 28. In this example, the spring 40 comprises a metal spring. One example metal spring is a coil spring. One example coil spring comprises flat spring steel.

In the illustrated example, the spring 40 is received against a rim 42 on a flow restrictor component 44. The spring 40 urges the rim 42 into engagement with the seal 30 and urges the seal 30 into engagement with the water seat 28. The spring 40 in this example biases the seal 30 in an axial direction along a central axis 46 of the sprinkler 20. The spring 40 ensures that there is an adequate seal provided by the polymer seal 30 even when there is not sufficient fluid pressure within the sprinkler for maintaining that seal. When there is fluid pressure within the flow path 24, that fluid pressure is effective for urging the seal 30 into engagement with the surfaces 36 and 38 for maintaining a desired seal at the interface between the flow path 24 and the water seat 28. The spring 40 ensures that there is an adequate seal at all times regardless of any fluid pressure within the sprinkler housing 22.

The flow restrictor component 44 is useful for controlling a flow rate through the sprinkler 20. The flow restrictor component 44 is moveable within the housing 22 into a position to control the flow from the sprinkler 20 if the seal 30 is no longer present or useful after being exposed to very high temperatures. For example, industry standard testing requires that a sprinkler nozzle be exposed to very high temperatures on the order of 800° C. and then cooled. The sprinkler nozzle should exhibit similar flow characteristics before and after the heating and cooling. The flow restrictor component 44 ensures that the illustrated example will satisfy such a standard. At temperatures on the order of 800° C., the polymer material of the seal 30 would essentially evaporate. The flow restrictor component 44 is configured to move toward a position where it can engage the support ring 32 under such conditions and the flow characteristics are approximately the same as when the seal 30 was in place as illustrated.

The example sprinkler 20 includes an activator bulb 52 that operates in a known manner for maintaining the sprinkler 20 in an inactive condition under most circumstances. When there is extreme heat, for example, a fluid within the activator bulb 52 causes the bulb to break, allowing the sprinkler 20 to become active in a known manner.

In the illustrated examples, an adjuster member 54, such as a set screw, is used for adjusting a position of the bulb 52 and the water seat 28 relative to the housing 22. Prior to supplying fire suppression fluid to the sprinkler 20, the water seat 28 is urged into contact with the polymer seal 30 by operation of the adjuster member 54. In this example, the contact between the water seat 28 as it is moved along the axis 46 (e.g., upward according to the drawing) introduces a bending stress on the polymer seal 30. This bending stress ensures that there will be an adequate seal at the interface between the water seat 38 and the flow passage 24. The bending stress introduces some amount of deflection of the polymer material of the seal 30 in some examples.

An O-ring seal 50 comprising an elastomeric material such as rubber is provided adjacent the seal 30 near the rim 42 for sealing off a fluid passage that otherwise may exist between an exterior of the seal 30 and an interior of the housing 22.

Figure 2:
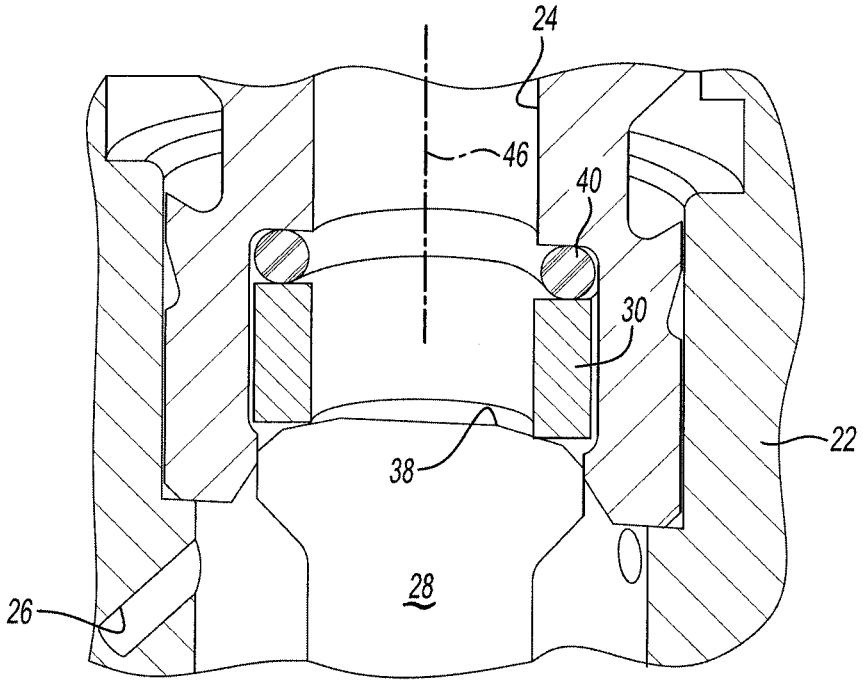
FIG. 2 is a cross-sectional illustration of selected features of another example embodiment.

FIG. 2 illustrates another example arrangement in which the spring 40 comprises an elastomeric element. In this particular example, the spring 40 comprises an O-ring. In this example, the spring 40 urges the seal 30 into engagement with the water seat 28 by urging the seal 30 in an axial direction parallel to the central axis 46 of the housing 22. In this example, the spring 40 is received directly against a surface of the polymer seal 30. When the water seat 28 is adjusted into position against the seal 30 in this example, sufficient pressure is applied to compress the spring 40 so that a bias against the seal 30 urging it into engagement with the water seat 28 results from the tendency of the spring 40 to expand into a non-compressed condition.

Figure 3:
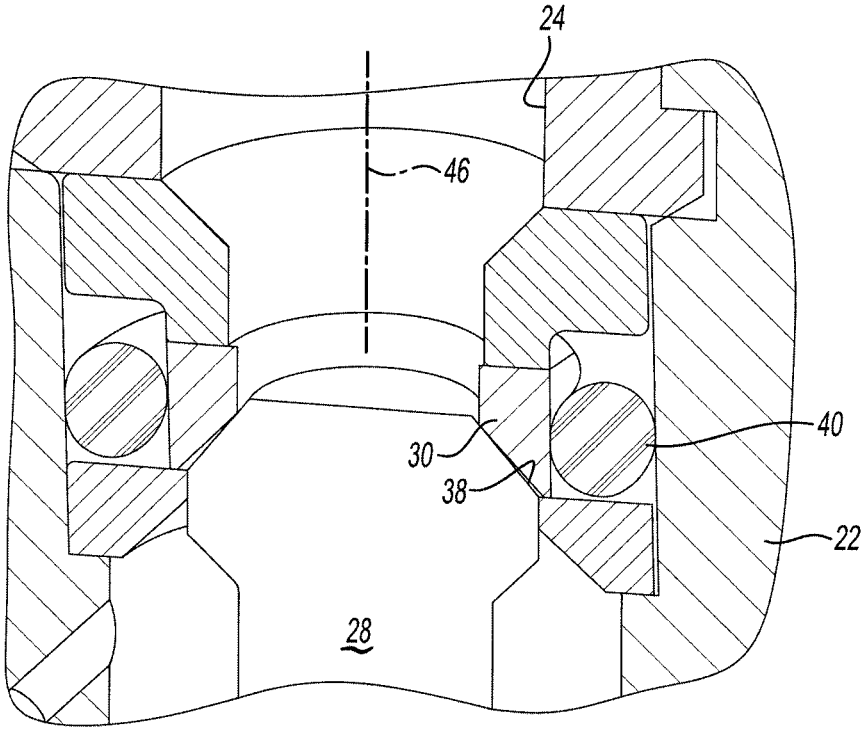
FIG. 3 is a cross-sectional illustration of selected features of another example embodiment.

FIG. 3 illustrates another example arrangement including an elastomeric spring member 40. In this example, the spring 40 comprises an O-ring. In this example, the spring 40 applies a bias that urges the seal 30 in a radially inward direction generally perpendicular to the central axis 46 of the housing 22. In this example, the spring 40 generally surrounds at least a portion of the seal 30. When the water seat 28 is moved into engagement with the seal 30 that tends to deflect the seal 30 in a radially outward direction, which results in compressing the seal 30. The tendency of the spring 40 to return to a non-compressed position provides a biasing force for urging the seal 30 into engagement with the water seat 28.

Figure 4:
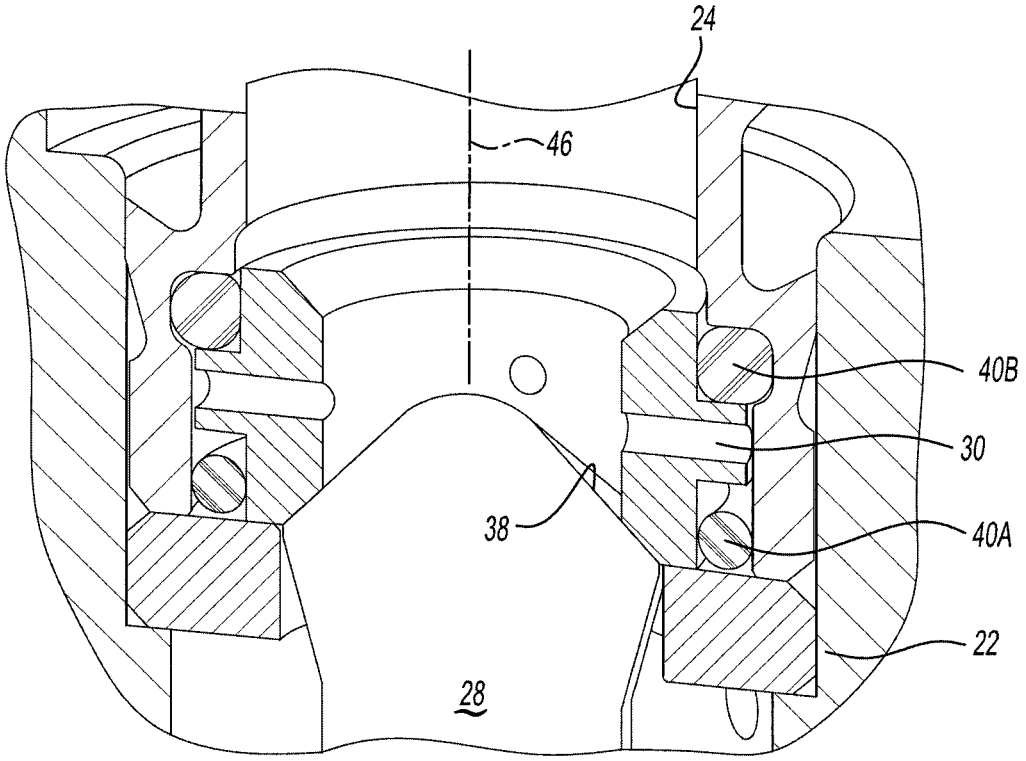
FIG. 4 is a cross-sectional illustration of selected features of another embodiment.

FIG. 4 illustrates another example arrangement in which the seal 30 is biased in an axial direction parallel to the central axis 46 and in a radial direction generally perpendicular to the axis 46. In this example, the spring comprises a first spring member 40A and a second spring member 40B. The first spring member 40A urges the seal 30 in a radially inward direction into engagement with the surface 38 on the water seat 28. The second spring member 40B urges the seal 30 in an axial direction into engagement with the water seat 28.

In the example of FIG. 4, the first spring member 40A and the second spring member 40B each comprises a resilient, elastomeric member. In one particular example, the spring members 40A and 40B each comprises an O-ring.

Although several different example embodiments have been illustrated and described above, embodiments of this invention are not necessarily limited to only those examples. It is possible, for example, the combine one or more features of one of the illustrated examples with one or more features of another of the illustrated examples.

The illustrated examples provide an adequate seal for higher pressure sprinkler systems such as misting systems. Previous designs that relied on cross-linked elastomer seals, such as rubber O-rings, as the primary sealing element may not work in some high pressure systems. For example, the pressure available from compressing a rubber seal with the water seat is limited by the nature of the activator bulb. Typical activator bulbs can withstand a normal load up to 1000 Newtons. Given that limitation, the compressing pressure that can be exerted on the seal by the water seat is limited. In higher pressure systems, the fluid pressure within the system may become high enough to counteract and overcome the compressing pressure applied by the water seat. Under such conditions, the effectiveness of the seal may be compromised. The illustrated embodiments described above, on the other hand, have a polymer seal 30 that is capable of withstanding the fluid pressures of higher pressure systems to consistently maintain a desired seal.

The illustrated examples provide a seal arrangement that is effective for various operating conditions. During inactive or idle conditions, the seal 30 withstands fluid pressures on the order of 25 Bar. The configuration of the seal 30 and its position within the housing 22 allows the fluid pressure to act on the seal 30 for urging it into position for maintaining a desired seal. With the illustrated examples, the sealing force increases as a function of fluid pressure in the housing 22.

In some idle conditions, the fluid pressure may drop below an expected amount or there may be no fluid pressure at all. This can occur during installation or service procedures, for example, when water supply to a sprinkler is turned off. The illustrated examples include the spring 40 to ensure that adequate pressure is applied to the seal 30 regardless of the fluid pressure.

During sprinkler activation, the physical characteristics of the seal 30, which are based at least in part on the polymer material, ensure that the seal 30 remains in a desired position within the housing 22. In the event of a fire, the activator bulb 52 breaks and the water seat moves away from the seal 30 allowing fire suppression fluid to flow through the central opening of the seal 30 and out of the sprinkler 20. The fluid pressure increases to 140 Bar in some examples. While the sprinkler 20 is active the seal 30 remains in the housing in the desired position. One aspect of the seal 30 is that it contributes to the flow characteristics of the sprinkler 20.

During activation of one sprinkler 20 it is possible for another sprinkler of the same system but in another room or area, for example, to remain inactive. An inactive sprinkler under those conditions will experience increased fluid pressure. The seal 30 is capable of withstanding high pressures even when the associated sprinkler is inactive while others of the same system or network are active and the pressure in the system is on the order of 140 Bar. Some seals 30 in sprinklers configured like the illustrated examples are capable of withstanding pressures up to 280 Bar without any loss of seal effectiveness.

Another aspect of at least the example shown in FIG. 1 is that it is capable of maintaining consistent flow characteristics even if the seal 30 is not present in the housing 22 because of the type of high temperature testing as mentioned above. After any high temperature conditions that would cause the seal 30 to no longer be in the expected position in the housing 22, the flow restrictor component 44 moves into a position to control the flow from the sprinkler 20 so that the flow characteristic is approximately the same with or without the seal 30.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. A fire suppression sprinkler, comprising:

a housing that establishes a flow path for discharging fire suppression fluid;

a water seat that is configured to close off the flow path;

a polymer seal supported within the housing and engaging the water seat for sealing an interface between the flow path and the water seat, the seal being supported within the housing in a manner that the seal remains in the housing in a condition in which fire suppression fluid flows out of the fire suppression sprinkler;

a spring that biases the polymer seal into engagement with the water seat, the spring being upstream of the polymer seal and the water seat; and an activation bulb that is breakable responsive to a condition in which fire suppression is desirable, the water seat having a first end received against the seal and a second end received against the bulb.

2. The fire suppression sprinkler of claim 1, wherein the spring comprises a metal spring.

3. The fire suppression sprinkler of claim 1, wherein the spring comprises a coil spring.

4. The fire suppression sprinkler of claim 1, wherein the spring comprises an elastomeric member.

5. The fire suppression sprinkler of claim 4, wherein the spring comprises an O-ring.

6. The fire suppression sprinkler of claim 1, wherein the seal comprises a bushing that is generally cylindrical and annular having an opening through a center of the seal.

7. The fire suppression sprinkler of claim 1, wherein the seal comprises polytetrafluoroethylene.

8. The fire suppression sprinkler of claim 1, wherein the housing defines an axis and the spring biases the seal in a direction along the axis.

9. The fire suppression sprinkler of claim 8, comprising a second spring that biases the seal in a direction that is generally perpendicular to the axis.

10. The fire suppression sprinkler of claim 9, wherein the spring and the second spring each comprise an O-ring.

11. The fire suppression sprinkler of claim 1, wherein the housing defines an axis and the spring biases the seal in a direction that is generally perpendicular to the axis.

12. The fire suppression sprinkler of claim 1, comprising a support ring received in the housing, the support ring engaging at least one surface on the seal, the water seat being received against the support ring to block the flow path.

13. The fire suppression sprinkler of claim 12, wherein the spring biases the seal into engagement with the water seat and into engagement with the support ring.

14. The fire suppression sprinkler of claim 1, comprising a flow restrictor having a rim received against a surface on the seal and wherein the spring urges the rim into engagement with the seal.

15. The fire suppression sprinkler of claim 1, comprising an adjusting member for adjusting a position of the bulb and the water seat relative to the housing, movement of the adjustment member being effective to urge the water seat into engagement with the seal and to introduce a bending stress on the seal.

16. The fire suppression sprinkler of claim 1, wherein the seal has a central opening and fire suppression fluid flows through the central opening in the condition in which fire suppression fluid flows out of the fire suppression sprinkler.

17. A fire suppression sprinkler, comprising:

a housing that establishes a flow path for discharging fire suppression fluid;

a water seat that is configured to close off the flow path;

a polymer seal supported within the housing in a manner that the seal remains in the housing in a condition in which fire suppression fluid flows out of the fire suppression sprinkler;

a spring that biases the polymer seal into engagement with the water seat into a condition in which the polymer seal and the water seat prevent fluid flow in the flow path past the water seat, the spring being upstream of the polymer seal and the water seat; and an activation bulb that is breakable responsive to a condition in which fire suppression is desirable, the water seat having a first end received against the seal and a second end received against the bulb.

18. The fire suppression sprinkler of claim 17, wherein the seal comprises polytetrafluoroethylene.

19. The fire suppression sprinkler of claim 17, comprising a support ring received in the housing, and wherein the support ring engages at least one surface on the seal, the water seat is received against the support ring to block the flow path, and the spring biases the seal into engagement with the water seat and into engagement with the support ring.

20. The fire suppression sprinkler of claim 17, comprising a flow restrictor having a rim received against a surface on the seal and wherein the spring urges the rim into engagement with the seal.

* * * * *